US008875328B1

(12) United States Patent
Atkinson et al.

(10) Patent No.: US 8,875,328 B1
(45) Date of Patent: Nov. 4, 2014

(54) PEDIATRIC HEAD POSITIONER

(71) Applicant: Mercy Medical Research Institute, Springfield, MO (US)

(72) Inventors: Scott Atkinson, Springfield, MO (US); Brarat Shah, Springfield, MO (US); Keela Davis, Springfield, MO (US); Martin Reuter, Flemington, MO (US); Anna Kelley, Walnut Grove, MO (US); Rahul Eapen, Springfield, MO (US)

(73) Assignee: Mercy Medical Research Institute, Springfield, MO (US)

( * ) Notice: Subject to any disclaimer, the term of this patent is extended or adjusted under 35 U.S.C. 154(b) by 0 days.

(21) Appl. No.: 14/026,085

(22) Filed: Sep. 13, 2013

Related U.S. Application Data

(60) Provisional application No. 61/701,111, filed on Sep. 14, 2012.

(51) Int. Cl.
*A61G 13/12* (2006.01)

(52) U.S. Cl.
USPC ..... 5/622; 5/621

(58) Field of Classification Search
USPC ..... 5/632, 655, 731, 733, 621–624
See application file for complete search history.

(56) References Cited

U.S. PATENT DOCUMENTS

| | | | | | |
|---|---|---|---|---|---|
| 4,790,041 | A * | 12/1988 | Shtull | ..... | 5/603 |
| 4,907,306 | A * | 3/1990 | Nakaji | ..... | 5/632 |
| 4,977,630 | A * | 12/1990 | Oswalt et al. | ..... | 5/632 |
| 5,524,640 | A * | 6/1996 | Lisak et al. | ..... | 5/655 |
| 5,566,413 | A * | 10/1996 | Webb et al. | ..... | 5/655 |
| 7,647,660 | B2 * | 1/2010 | Tullous | ..... | 5/655 |

* cited by examiner

*Primary Examiner* — Fredrick Conley
(74) *Attorney, Agent, or Firm* — Lathrop & Gage LLP

(57) ABSTRACT

A positioning device is described for supporting the chest and head of a patient in a desired position during a medical procedure. The device includes removable inserts that allow the device to be adjusted to fit the size of the patient's head and torso.

3 Claims, 6 Drawing Sheets

PEDIATRIC HEAD POSITIONER

CROSS REFERENCE TO RELATED APPLICATIONS

This non-provisional application claims priority of U.S. Provisional Patent Application No. 61/701,111 filed on Sep. 14, 2012, which is incorporated herein by reference.

BACKGROUND

Field of the Invention

The head positioning device described herein is in the field of devices to support and position a person, such as a child. More specifically, the device supports a head of a person during a medical procedure such as surgery. The prone positioning device is utilized along with a surgical table, such as an eye cart.

SUMMARY OF THE INVENTION

Embodiments of the head positioning device described herein include a smaller, or head, portion, and a larger, or torso, portion. Each, or both, of the portions include one or more removable sections, sometimes referred to as inserts. The sections may be made of foam or other conformable materials, and are added or removed in order to customize the head positioning device to the size of a patient that is positioned within the device.

In some embodiments, the device supports a head and upper body of a patient during a surgical procedure in a prone or supine position on a surgical table, and includes a support portion having a receiving cavity which defines an area in which to support a patient, and one or more removable sections within the receiving cavity, wherein removal of the one or more removable sections causes the receiving cavity to increase the defined area in which to support the patient.

DETAILED DESCRIPTION

The head positioning device supports the head, neck and all or a portion of the torso of a person in a prone or supine position. The device is typically utilized to support a patient during a medical procedure. Without a device to support a patient during a medical procedure, the medical personnel have to create a temporary support for the patient using materials such as towels, pillows or other items at hand.

In some embodiments, the head positioning device supports the head, neck and upper torso while a patient is positioned on an eye cart or other surgical table used, for example and without limitation, during ENT (ear, nose, and throat) and ophthalmic surgeries. In various embodiments, the head positioning device includes support portions, such as a head support portion and a torso support portion that are configured and adapted to support a patient, such as a child, on a surgical table. The support portions may include removable sections that are utilized to adjust a size of the support portions to adapt to a size of a patient.

The head positioning device also includes attachment mechanisms, such as straps, that securely attach and/or fix the head positioning device to a surgical table, such as an eye cart.

Figure 1A:
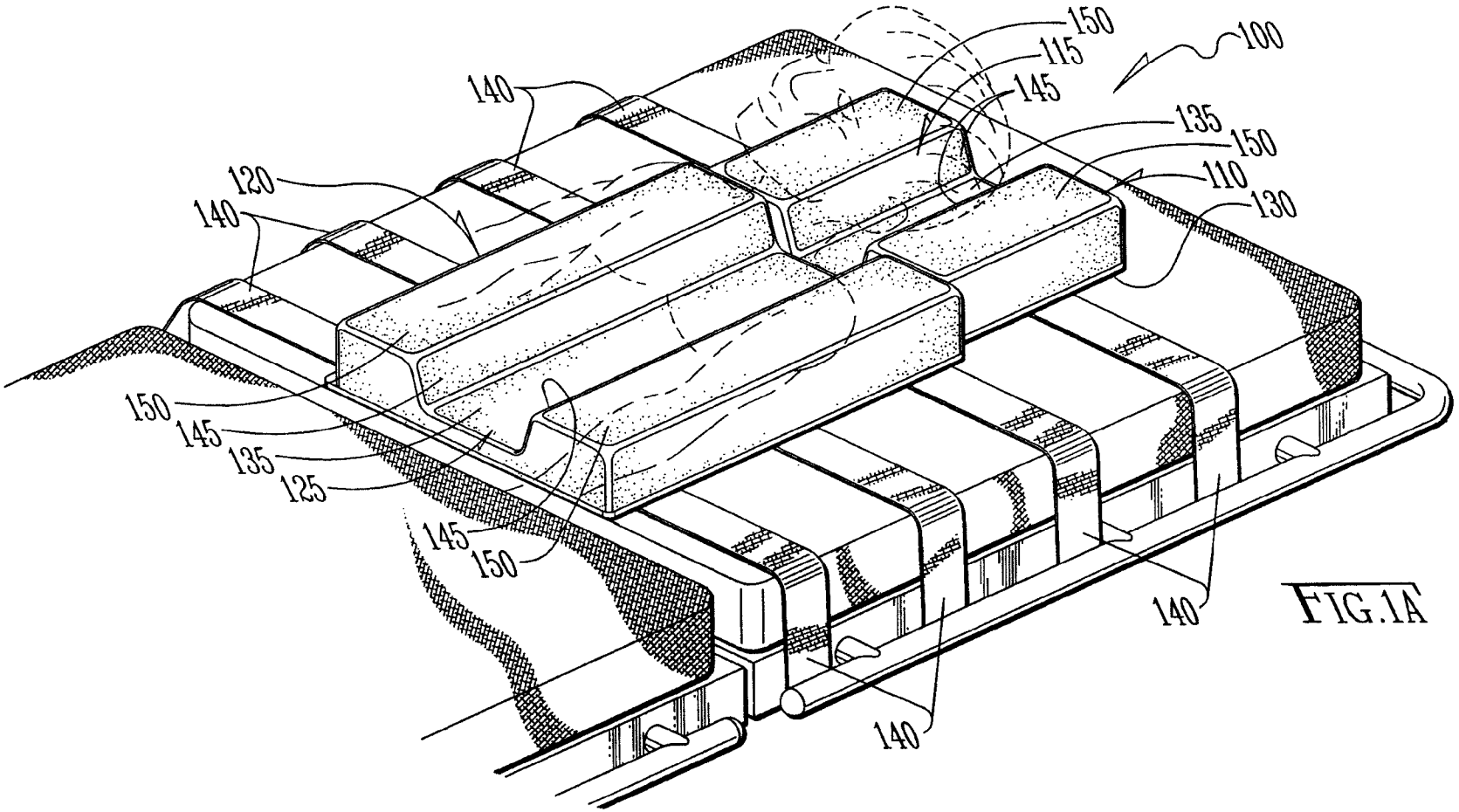
FIG. 1A is a perspective view of an embodiment of the head positioning device.
Figure 1B:
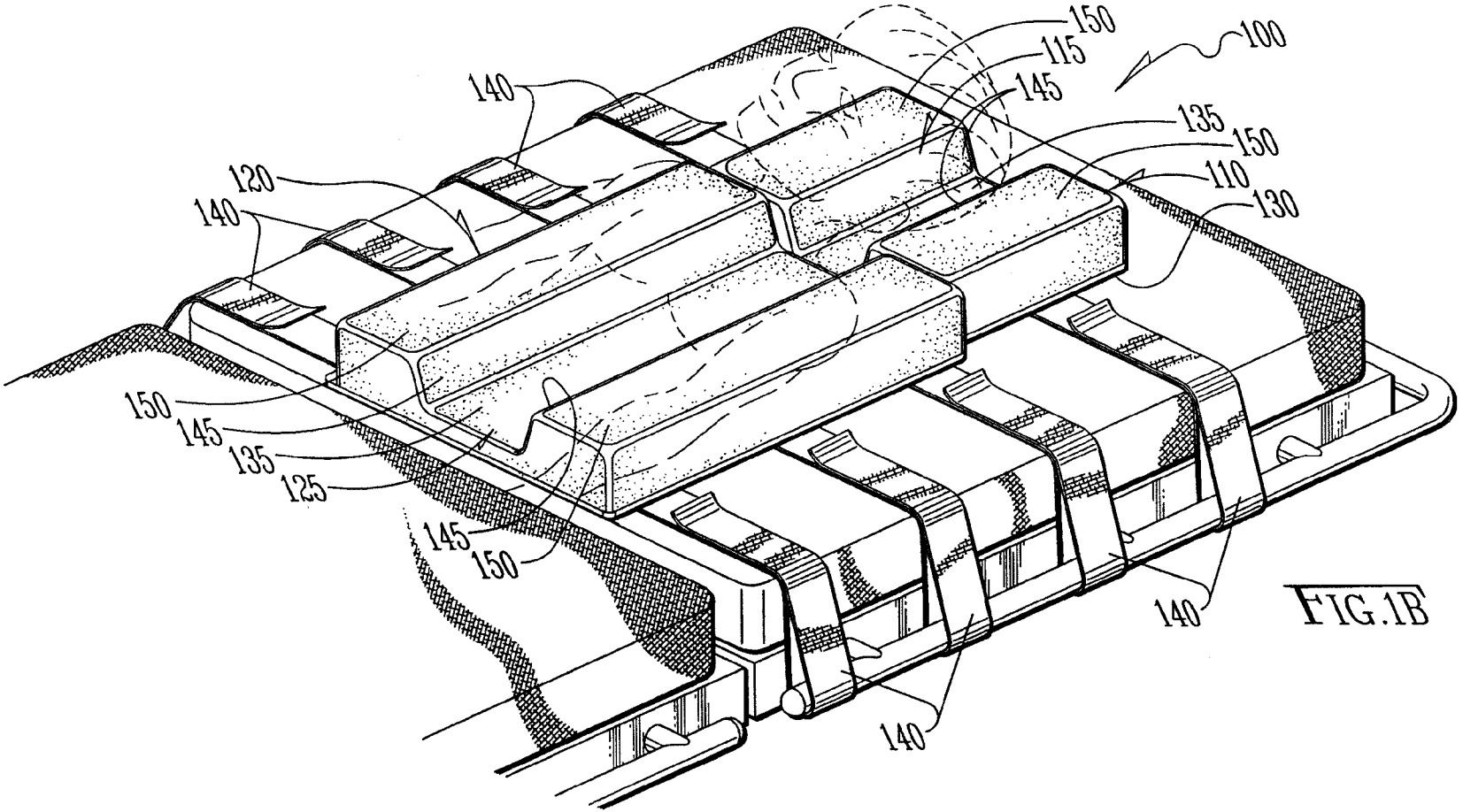
FIG. 1B is a perspective view of an embodiment of the head positioning device.

Referring now to FIGS. 1A and 1B, perspective views of an embodiment of the head positioning device 100 are shown. The head positioning device 100 includes a head support portion 110, which is generally the smaller or narrower portion, and a body or torso support portion 120, which is generally the larger or wider portion.

The head support portion 110 includes a head receiving cavity 115 which is adapted to receive, support, and/or position the head of a patient, such as the head of a child, during a surgical procedure. The torso support portion 120 includes a torso receiving cavity 125, which is adapted to receive, support, and/or position the torso of the patient, such as the shoulders, during the surgical procedure. The head receiving cavity 115 and the torso receiving cavity 125 each comprise a lower central surface 135 disposed along the length of the device, and two angled surfaces 145 extending upwardly from the lower central surface 135 to top surfaces 150. The torso receiving cavity 125 is typically wider than the head receiving cavity 115, though in embodiments they may be the same width. In an embodiment of the device, the angle 410 (shown in FIG. 4) between the lower central surface 135 and the angled surfaces 145 is 121°, though in other embodiments other angles may be utilized between surfaces.

The device 100 is typically formed from one or more types of foam to provide firm but comfortable support to the patient, such as memory shape foams. The foam may be covered with an outer skin to resist fluids and wear to the foam, or it may be exposed foam as appropriate for the application. The device may be produced in one or more sizes designed to fit a variety of sizes of patient, from children to adults of various size. The device 100 is contoured to fit to the body of the patient, and to firmly but comfortably support the patient in position for the medical procedure.

The head positioning device 100 also includes a baseboard 130. The baseboard, which may be formed of a material that is more rigid than the foam-based head support portion 110 and torso support portion, maintains the support portions in a flat configuration and facilitates a rigid, secure attachment of the device 100 to a surgical table via the attachment straps 140. The rigid material may be wood, plastic, metal, semi-rigid foam or similar materials.

The device 100 also comprises attachment straps 140 for releaseably attaching the device 100 to a surgical table on which it will be used to support a patient. Each strap 140 may be secured to its other end underneath the table as depicted in FIG. 1A. Alternatively, each strap 140 may be secured around rails or other elements of the surgical table on which the device 100 is disposed for use. The straps may be secured to themselves or directly to the table by a variety of fasteners suitable for the purpose. The fasteners may include hook and loop material attached to the straps or the table, clips, buckles, snaps and similar means of attachment. The method of attachment of the straps is not limiting of the invention described and claimed herein.

Figure 2:
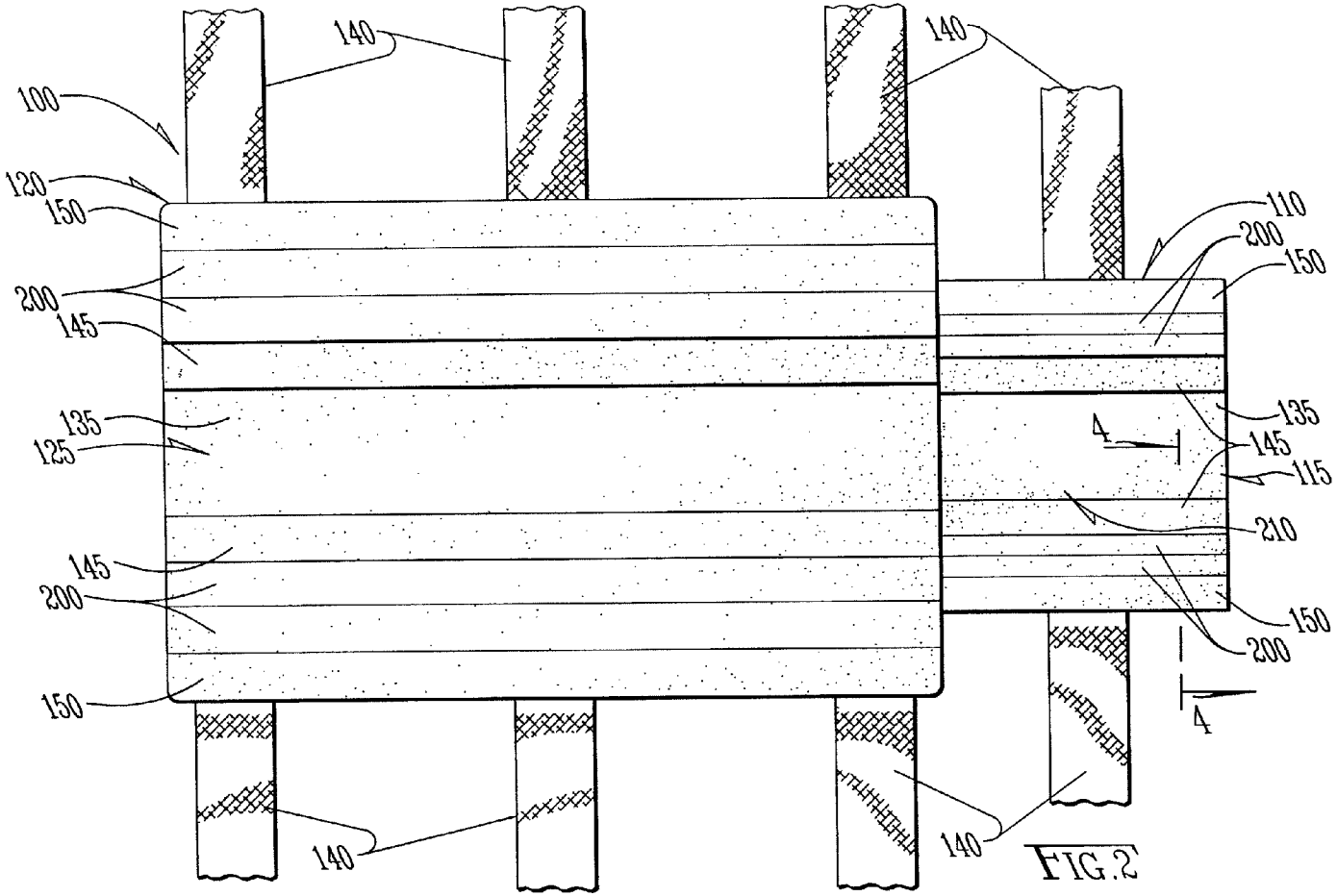
FIG. 2 is a top view of an embodiment of the head positioning device.

Referring to FIG. 2, a top view of a head positioning device 100 is shown. The receiving cavities, such as the head receiving cavity 115 and the torso receiving cavity 125, are configured to comfortably support a patient in various positions during a surgical procedure, such as an ENT procedure or ophthalmic procedure.

The cavities may be formed in a variety of sizes and geometries, such as geometries that are similar to the shape of a patient. For example, a cavity may have a shape similar to a shape of a patient's head, shoulders, torso, neck, and so on. In the depicted embodiment the cavities are uniform in width along the length of the device 100.

Figure 3:
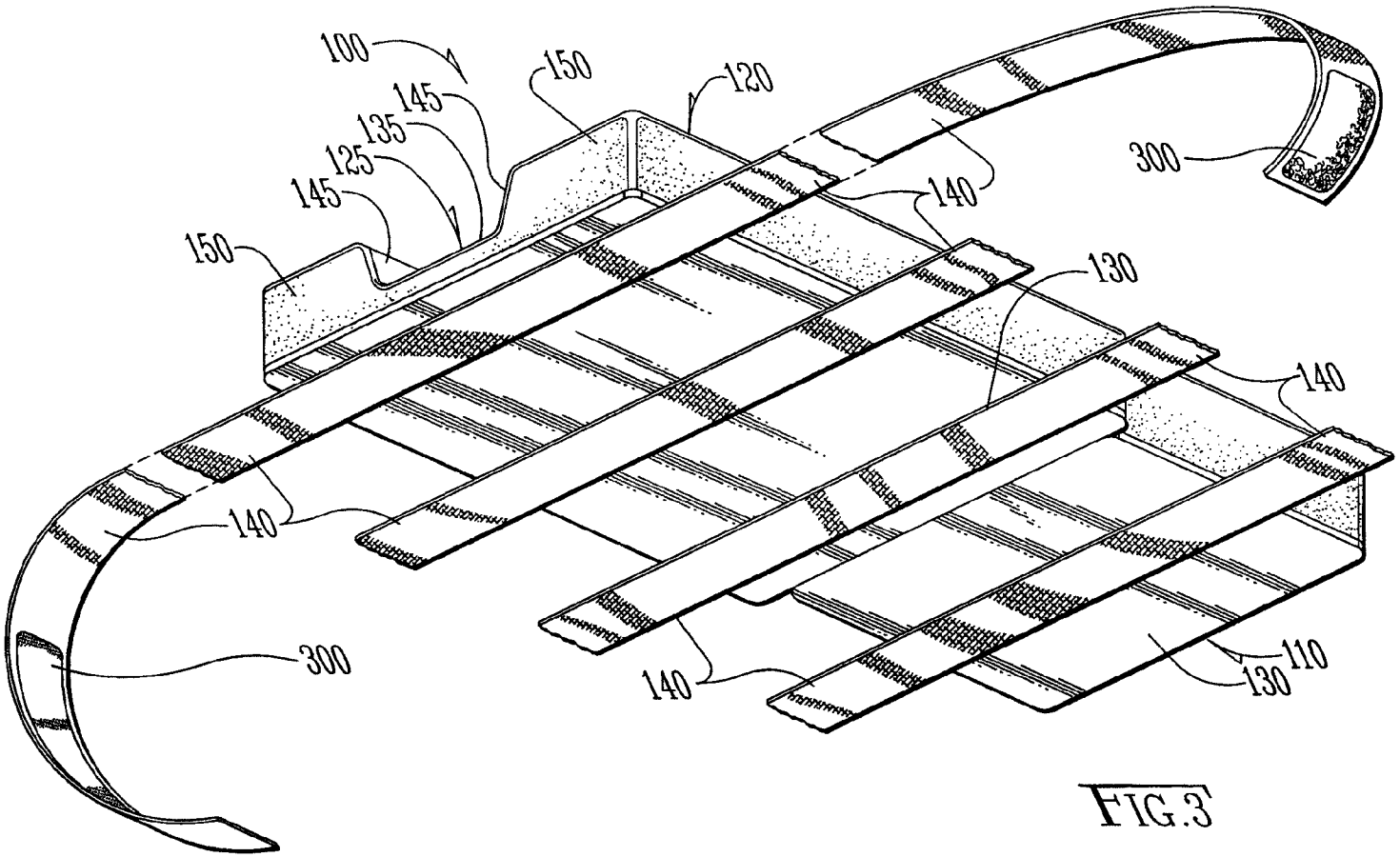
FIG. 3 is a bottom perspective view of an embodiment of the head positioning device.

In some embodiments, the device 100 may be provided with one or more removable sections or inserts 200, such as foam inserts positioned at the edges or boundaries of the cavities 115 or 125. When customizing a head positioning device 100 for a patient, the inserts 200 may be removed or added, depending upon the size or shape of a patient, among other things. The removable inserts 200 may be layered, as shown in FIG. 3, if necessary to achieve the desired width of the cavities 115 and 125. The removable inserts 200 may be held in place with Velcro, releaseable adhesives, or tearable attachments, or simply held by friction between the inserts 200 and the device 100.

Referring to FIG. 3, a bottom view of the head positioning device 100 is shown. As described herein, the baseboard 130 may include attachment straps 140 or other attachment mechanisms. The attachment straps may include fasteners 300 that facilitate the attaching of the straps 140 to a surgical table or other apparatus. Example fasteners may include hook and loop material, clips, buckles, and similar means of attachment. In the depicted embodiment each strap has two areas 300 of hook and loop material to releaseably engage each other around the surgical table on which the device 100 is disposed for use, thus securing it in place thereon.

Figure 4:
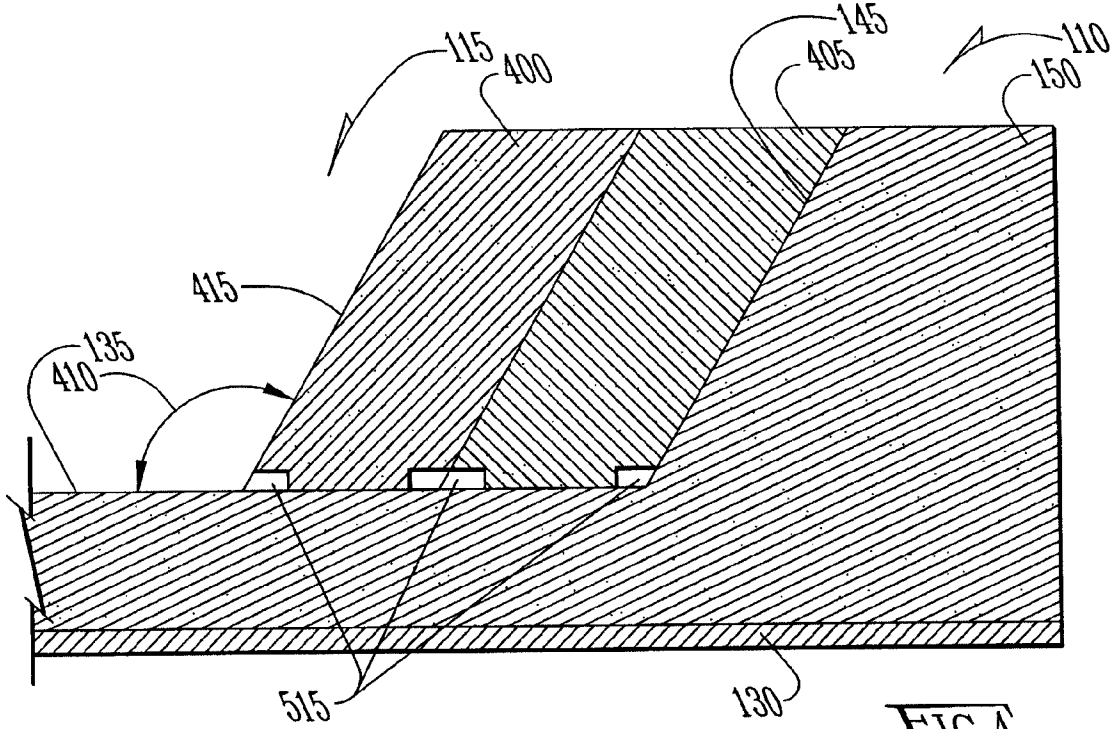
FIG. 4 is a detailed cross-sectional view of a portion of an embodiment of the head positioning device with a removable section.

As described herein, in some embodiments, the head positioning device 100 includes a support portion having a removable insert or inserts, such as one or more removable sections within a receiving cavity. Referring to FIG. 4, a cross-sectional view of a portion of an embodiment of the head positioning device 100 that shows removable inserts 400 and 405 is shown. The cross-section of the other side of device 100 would be similar to that shown in FIG. 4.

The removable inserts 400 and 405, when located within the receiving cavity 115, for example, provides a narrower or smaller area in which to support a patient. If a larger area is required, the inserts 400 or 405 may be removed, either one or both, which provides a wider or larger area in which to support a patient. Removable inserts 400 and 405 mate to angled surface 145 and a portion of the lower central surface 135, and provides an angled surface 415 to define the narrow cavity 115 or 125. Angle 410 between lower surface 135 and angled surface 145 may vary as needed, but in some embodiments is between 90° and 145°. The device 100 may be provided with both removable inserts 400 and 405 or only a single insert 405 on each side.

The removable inserts 400 and 405 may be torn away when preparing or customizing the head positioning device for a specific patient. In one embodiment of torso support portion 120 of the device as depicted in FIG. 4, each section 400 and 405 may be 1.5 inches thick, the lower surface 135 may be 10 inches wide and overlaid by 3 inches on each side by the removable inserts 400 and 405, the device may be 3.5 inches thick at the top surfaces 150 and 1 inch thick at the lower surface 135, the top surfaces may be 1.5 inches wide and the angled surfaces extend 1.5 inches horizontally and 2.5 inches vertically from the lower surface 135 to the upper surface 150. Many other variations of these dimensions are within the scope of the present invention. Removable inserts 400 and 405 may be provided with notches 515 along the corners of the inserts, for removable attachment means or for drainage or for other purposes as necessary.

For example, a head positioning device 100 having the removable sections shown in FIG. 4 would provide three different custom sized head receiving cavities, a small, or narrow, size when both removable sections 400 and 405 are maintained with the head support portion 110, a medium, or normal width size, when the inner section 400 is removed from the head support portion 110, and a large, or wide, size when both the inner section 400 and the outer section 405 are removed from the head support portion 110. Similar configurations would be allowed with the torso support portion 120.

Of course, one of ordinary skill in the art will realize that the head positioning device 100, and its various support portions, may include any number of removable inserts or sections, and not only the number of removable inserts or sections shown herein.

Figure 5:
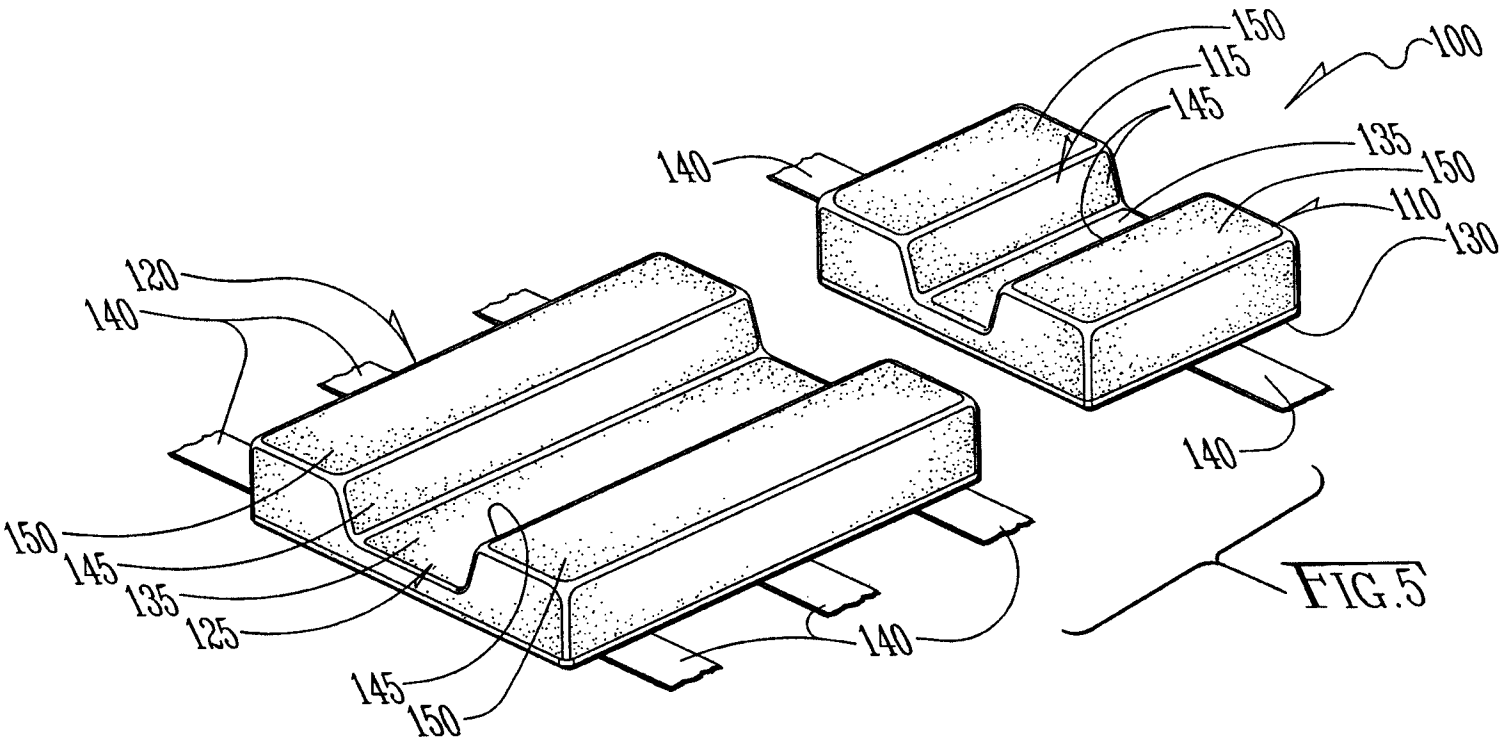
FIG. 5 is an exploded perspective view of an embodiment of the head positioning device.

Referring now to FIG. 5, an exploded perspective view of an embodiment of the head positioning device 100 is depicted. As shown in FIG. 5, the head support portion 110 may be separated from the torso support portion 120 in certain embodiments. Each portion may be used with or without the other in positioning a patient.

Further, the head positioning device may be manufactured or formed in a variety of ways to facilitate removal of inserts or sections. For example, the inserts or sections may be attached to the support portions via perforated sections of the covering or of the support material itself, may be attached via slots, hook-and-loop material or other mating mechanisms, may be placed without any specific attachments, and so on.

Thus, in some embodiments, the head positioning device 100, such as the various head positioning devices described herein, is configured to securely support and maintain a patient, such as a pediatric patient, regardless of size or shape, during a surgical procedure, such as an ENT or ophthalmic procedure. The device 100 may include a customizable head support portion 110, a customizable torso support portion 120, or both. The device 100 may be customizable via removable or tearable inserts located within receiving cavities of the support portions, which facilitate easy and effective resizing or other customizations of the device 100, among other benefits.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A positioning device for use with a surgical table, the head positioning device comprising:

a baseboard;

a head support portion disposed on the baseboard having a head cavity for supporting a head of a patient in a supine position;

a torso support portion disposed on the baseboard adjacent to the head support portion, said torso support portion having a torso cavity for supporting a torso of a patient in the supine position; and an attachment mechanism for releaseably attaching the head positioning device to a surgical table;

wherein the head cavity and the torso cavity each comprise a planar lower central surface and two planar angled side surfaces extending upwardly from the lower central surface at a first obtuse angle thereto;

wherein the planar lower central surfaces of the head cavity and the torso cavity extend along a length of the baseboard;

wherein the head support portion further comprises at least one removable section disposed in the head cavity; and wherein the torso support portion further comprises at least one removable section disposed in the torso cavity;

the at least one removable section having a planar front side, a planar top, a planar bottom and a planar back side, wherein the bottom and the back side are disposed to each other at the first obtuse angle and the bottom and the front side are disposed to each other at an acute angle that is supplementary to the first obtuse angle;

wherein the planar front side is parallel to the planar back side of the removable section, and the planar bottom is parallel to the planar top side; and wherein the bottom of the at least one removable sections abut and releaseably attached to a portion of the lower central surface of either the head cavity or the torso cavity extending along the length thereof, and the back side of the at least one removable sections abut and are releaseably attached to the side surfaces of either the head cavity or the torso cavity;

wherein the width of the head cavity and the width of the torso cavity may be varied independent of each other by selectively removing the at least one removable sections from the head cavity or the torso cavity.

2. The positioning device of claim 1 wherein the at least one removable sections are formed as part of the head support portion and the torso support portion and are removable by tearing perforated segments attaching the at least one removable sections to the support portions.

3. The positioning device of claim 2 wherein the attachment mechanism comprises straps attached to the baseboard; wherein the straps are provided with a fastener selected from the group consisting of hook and loop material, snaps, clips and buckles.

* * * * *